US005980019A

United States Patent [19]

Kisa

[11] Patent Number: 5,980,019

[45] Date of Patent: Nov. 9, 1999

[54] CHARACTER PRINTING METHOD IN INK-JET RECORDER

[75] Inventor: Kazuyuki Kisa, Kanagawa, Japan

[73] Assignee: Fuji Electric Co., Ltd., Kawasaki, Japan

[21] Appl. No.: 08/976,615

[22] Filed: Nov. 24, 1997

Related U.S. Application Data

[63] Continuation-in-part of application No. 08/403,443, Mar. 14, 1995, abandoned.

[30] Foreign Application Priority Data

Mar. 18, 1994 [JP] Japan ..... 6-048037

[51] Int. Cl.[6] ..... B41J 2/145; B41J 2/15; B41J 29/38; B41J 23/00

[52] U.S. Cl. ..... 347/40; 347/37; 347/9

[58] Field of Search ..... 347/40, 43, 9, 347/12, 37, 5, 104; 346/33 TP, 46; 395/108

[56] References Cited

U.S. PATENT DOCUMENTS

| | | | |
|---|---|---|---|
| 1,709,926 | 4/1929 | Weaver | 347/43 X |
| 4,353,079 | 10/1982 | Kawanabe | 347/12 |
| 4,404,572 | 9/1983 | Okamura et al. | 347/37 |
| 4,515,487 | 5/1985 | Minami | 400/240.4 |
| 4,543,590 | 9/1985 | Tazaki et al. | 347/43 |
| 4,631,548 | 12/1986 | Milbrandt | 347/43 |
| 5,354,135 | 10/1994 | Sakagami et al. | 395/108 X |
| 5,408,590 | 4/1995 | Dvorzsak | 347/5 X |
| 5,424,720 | 6/1995 | Kirkpatrick | 346/33 TP |

FOREIGN PATENT DOCUMENTS

| | | | |
|---|---|---|---|
| 455-389 | 11/1991 | European Pat. Off. | 347/43 |
| 3317281 | 11/1983 | Germany . | |
| 3534108 | 7/1986 | Germany . | |
| 3919085 | 12/1990 | Germany . | |

*Primary Examiner*—N. Le
*Assistant Examiner*—Thinh Nguyen
*Attorney, Agent, or Firm*—Finnegan, Henderson, Farabow, Garrett & Dunner, L.L.P.

[57] ABSTRACT

An ink-jet recording head is used to print characters simultaneously with a recording line. Data on measured temperature values in a data buffer 12 and what relates to one of the horizontal lines of a designated character pattern in a character buffer 14 are separately written by a write unit 10 into respective line buffers 8Y, 8R, 8B in accordance with respective printing colors after recording paper 1 is fed by 0.4 mm. The data in respective line buffers are read by a read unit 20 in synchronization with the travel of the recording head 4 via a pulse from a pulse generator 23 before being sent to respective drive units 30Y, 30R, 30B. The driving outputs are each applied to the corresponding piezoelectric elements 9Y, 9R, 9B and when the recording head 4 arrives at a predetermined printing position during the travel, corresponding color ink is jetted thereat. Consequently, the temperature value at a certain point of time and one of the horizontal lines of the dot matrix of the character designated is printed. Character printing is thus completed as the printing operation above is repeated.

8 Claims, 5 Drawing Sheets

| NO. | PRINTING COLOR | SUPERIMPOSING COLOR | | |
|---|---|---|---|---|
| | | Y | R | B |
| 1 | YELLOW | ○ | | |
| 2 | RED | | ○ | |
| 3 | BLUE | | | ○ |
| 4 | BITTER ORANGE | ○ | ○ | |
| 5 | PURPLE | | ○ | ○ |
| 6 | GREEN | ○ | | ○ |
| 7 | BLACK | ○ | ○ | ○ |

CHARACTER PRINTING METHOD IN INK-JET RECORDER

This application is a continuation-in-part, of application Ser. No. 08/403,443, filed Mar. 14 1995, now abandoned.

BACKGROUND OF THE INVENTION

1. Field of the Invention

The present invention relates to a character printing method in an ink-jet recorder by means of an ink-jet recording head of the recorder so as to print, for example, measuring point numbers simultaneously with memos and messages for giving opinions or sending requests along a trend recording line of recording paper.

2. Description of the Related Art

In order to deal with the problem of making a measuring point number correspond to a trend recording line that has been recorded in a conventional recorder, ink of two or three colors has been employed for an ink type recorder, and ink of 6 to 12 colors (monochrome or mixed color) for an impact or ink-jet type recorder. In the case of such an impact type recorder in particular, there has been adopted a method of pressing numeric types affixed to a recording head against recording paper each time the type indicating a measuring point number is struck a prescribed number of times. Even in this case, the measuring point number is intermittently printed along the recording line.

The conventional methods have the following shortcomings. Firstly, a color-to-color contrast tends to become vague at a glance provided not less than six kinds of colors are used to indicate kinds of measuring point numbers in ink color. Secondly, the type face is limited to a single number, character or symbol and this is inconvenient in some cases. In addition, there is a case in the area of a wishful demand where an operator wishes to write a memo or a message for giving opinion or sending a request on recording paper and if the ink-jet recording head mounted in the recorder is usable for printing such a message instead of manually writing it with writing implements, it would be extremely convenient.

SUMMARY OF THE INVENTION

The present invention has been made to solve the foregoing problems with the prior art, and an object of the invention is to provide a character printing method in an ink-jet recorder by means of an ink-jet recording head of the recorder so as to print, for example, measuring point numbers simultaneously with memos and messages for giving opinions or sending requests along a trend recording line of recording paper.

A character printing method applicable according to the present invention to an ink-jet recorder in which belt-like recording paper is intermittently fed by a predetermined feed every predetermined period so that a character having a character pattern in the form of a dot matrix is printed while an ink-jet recording head having a single nozzle is traveling over the whole graduated width after the recording paper is thus fed, comprises the steps of making the recording head travel over the whole graduated width the same number of times as the number of dots belonging to the vertical line of each dot matrix (hereinafter called a one character travel) to print characters arranged in a line, and causing ink to be jetted from the nozzle to carry out single color printing when the nozzle of the recording head passes a position corresponding to each dot belonging to the same horizontal line counted from the bottom of the dot matrix of the character designated during the travel pertaining to the one character travel in the order of time series.

A character printing method applicable according to the present invention to an ink-jet recorder in which belt-like recording paper is intermittently fed by a predetermined feed every predetermined period so that a character having a character pattern in the form of a dot matrix is printed while an ink-jet recording head having nozzles for jetting ink of three colors, yellow, red and blue, is traveling over the whole graduated width after the recording paper is thus fed, comprises the steps of providing the recording head with parallel nozzles for jetting yellow, red and blue ink in the direction in which the recording head travels, making the recording head travel over the whole graduated width the same number of times as the number of dots belonging to the vertical line of each dot matrix, that is, letting the recording head make a one character travel, to print characters arranged in a line and causing ink to be jetted from the nozzle that has alternatively been selected to carry out single color printing and from a combination of two out of three nozzles or all three nozzles to carry out mixed color printing when each nozzle of the recording head passes a position corresponding to each dot belonging to the same horizontal line counted from the bottom of the dot matrix of the character designated during the travel pertaining to the one character travel in the order of time series.

Moreover, ink may be jetted to each dot for single color printing at an additional position deviating by a quantity corresponding to adjoining one address on a line buffer from the normal printing position so as to carry out superimposing printing. Further, the dot matrix should preferably be formed with strings of 8 horizontal dots by 10 vertical dots.

By making the recording head travel over the whole graduated width the same number of times as the number of dots belonging to the vertical line of each dot matrix, that is, letting the recording head make the one character travel, the characters arranged in a line are printed. In other words, ink is caused to be jetted from the nozzle to carry out single color printing when the nozzle of the recording head passes a position corresponding to each dot belonging to the same horizontal line counted from the bottom of the dot matrix of the character designated during the travel pertaining to the one character travel in the order of time series. In this case, the vertical dot-to-dot interval in the dot matrix is equivalent to the feed of recording paper.

Accordingly, an embodiment of the present invention involves moving an ink-jet recording head having a first nozzle in a traveling direction over a width of the recording paper a number of times corresponding to the number of vertical lines of a character dot matrix. This number of times the recording head moves also corresponds to the number of dots in one vertical line of the number of vertical lines of the character dot matrix. Also, to accommodate intermittently fed belt-like recording paper, an embodiment of the present invention prints a character from the last line to the first line of a character dot matrix.

Because of this specific order for printing lines of a character, an embodiment of the present invention enables a compact printer design. The printing method of the present invention allows, for example, feeding a recording sheet in a downward direction perpendicular to the traveling direction of the recording head. With lines of a character in the present invention printed from bottom to top, printed data and messages on the recording sheet appear right side up and can be easily read as recording is in progress. In addition, the recording paper fed past the recording head in the present invention can collect and this paper can fold under its own weight at a location below the recording head.

Unlike the present invention, other recording apparatuses print a character starting with the top line and ending with the bottom line, if they were to receive belt-like recording paper, printed data and messages would appear upside down and would not be readable during recording; they would require feeding belt-like recording paper upward from below the recording head. Although printed data and messages would be readable, additional structure would be required above the recording head to collect the recording paper. This required additional structure prevents the recording apparatus of other devices from achieving a compact design enabled by the present invention.

By providing the recording head with parallel nozzles for jetting yellow, red and blue ink in the direction in which the recording head travels, and making the recording head travel over the whole graduated width the same number of times as the number of dots belonging to the vertical line of each dot matrix, that is, letting the recording head make a one character travel, to print characters arranged in a line. In other words, ink is caused to be jetted from the nozzle that has alternatively been selected to carry out single color printing of three kinds, yellow, red and blue, and from the combination of two out of three nozzles or all three nozzles to carry out mixed color printing of four kinds: bitter orange with yellow and red, green with yellow and blue, purple with red and blue, and black with yellow, red and blue, when each nozzle of the recording head passes a position corresponding to each dot belonging to the same horizontal line counted from the bottom of the dot matrix of the character designated during the travel pertaining to the one character travel in the order of time series.

Moreover, ink may be jetted to each dot for single color printing at an additional position deviating by a quantity corresponding to adjoining one address on the line buffer from the normal printing position so as to carry out superimposing printing. Consequently, the character looks substantially uniformly thick because the same amount of ink as in the case of mixed color printing sticks thereto. Since the dot matrix is formed with strings of 8 horizontal dots by 10 vertical dots, further, 1-byte processing becomes not only feasible but also simple from the standpoint of software.

The above and other objects and features of the present invention will be more apparent from the following description taken in conjunction with the accompanying drawings.

DETAILED DESCRIPTION OF THE PREFERRED EMBODIMENTS

Figure 1:
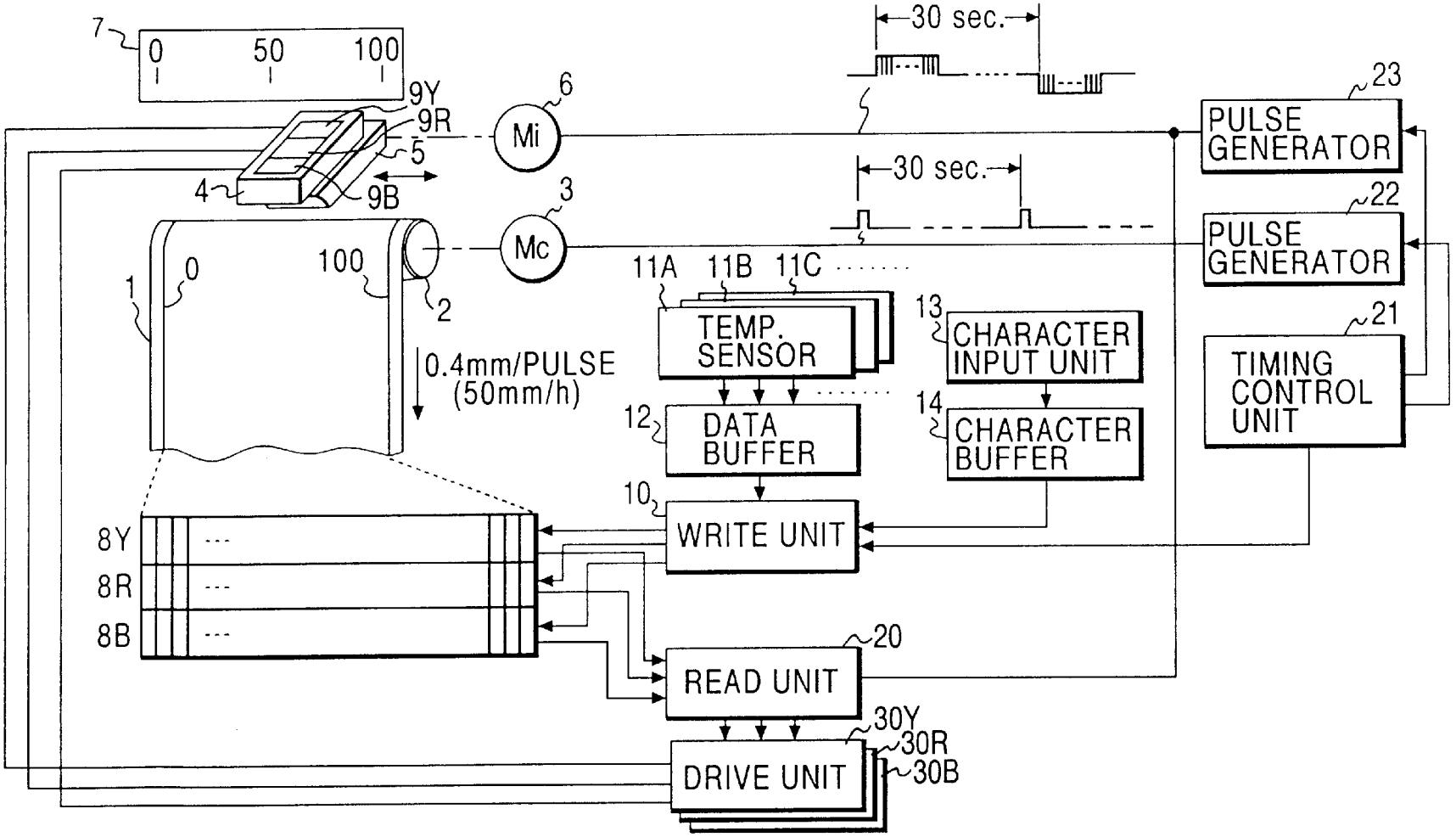
FIG. 1 is a block diagram illustrating the construction of a recorder to which the present invention is applied.
Figure 2A:
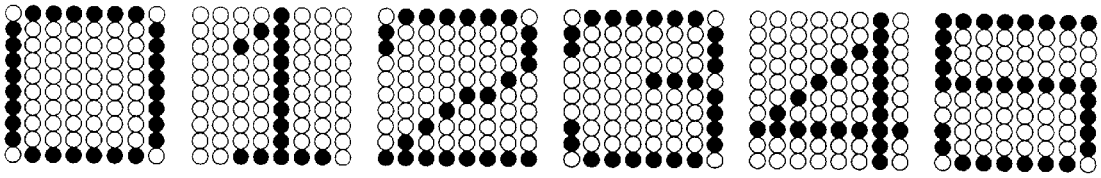
FIGS. 2(*a*), 2(*b*), 2(*c*) and 2(*d*) are diagrams showing exemplary various character patterns.
Figure 2B:
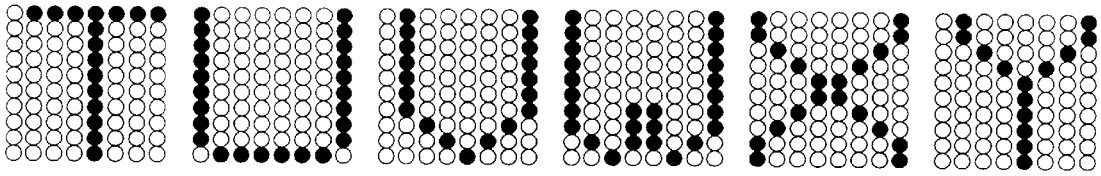
Figure 2C:
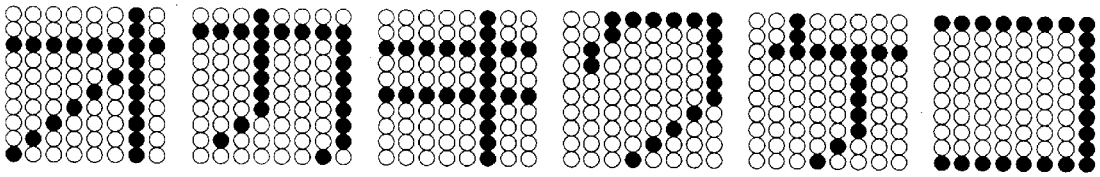
Figure 2D:
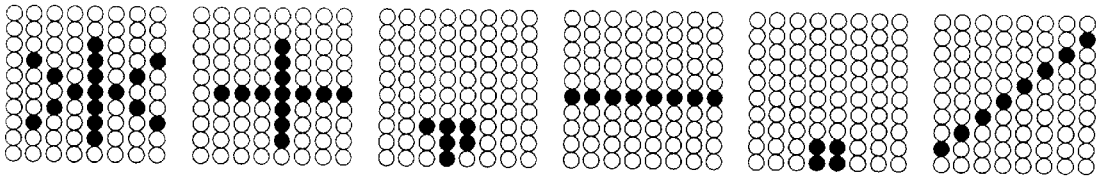

Referring to drawings, a description will subsequently be given of an application of a character printing method to an ink-jet recorder according to the present invention. FIG. 1 is a block diagram illustrating the construction of a recorder according to an embodiment of the invention. As shown in FIG. 1, this recorder is roughly classified into three sections: a recorder main body as the first section; a data processing unit as the second section relating to measurement and characters; and an operating unit as the third section for operating the recorder main body. The first, second and third sections will be described in order.

As far as measurement-recording and character printing are concerned, the recorder main body includes a feed roll 2 for feeding recording paper 1, a feed motor 3 (represented by Mc) for driving the feed roll 2, a traveling stand 5 which is loaded with a recording head 4 and reciprocates in the widthwise of graduations, a traveling motor 6 (represented by Mi) for driving the traveling stand 5, and a scale plate 7. The recording head 4 has nozzles each for jetting ink of three colors (yellow, red and blue) and is equipped with piezoelectric elements 9Y, 9R, 9B corresponding to the three colors. In this case, Y, R and B represent yellow, red and blue, respectively.

The data processing unit includes temperature sensors 11A, 11B, 11C, . . . for measuring temperatures at a lot of measuring points in a plant, a data buffer 12 for temporarily storing measured data at respective latest points of time, a character input unit 13 for designating characters (e.g., numeric characters, alphabets, kana, katakana, symbols) to be printed and their locations, line buffers 8Y, 8R, 8B for temporarily storing data for use in printing the three colors, a data write unit 10 for writing data to the respective buffers, and a data read unit 20 for reading data therefrom.

While being sequentially updated, the latest temperature data in the respective temperature sensors are stored in the data buffer 12. Incidentally, the latest temperature data is not restricted to a moment-to-moment value but may refer to a mean value of the maximum and minimum values for a fixed period of time, for example. Data on character patterns designated via the character input unit 13 and their locations are stored in the character buffer 14 as follows. The character pattern is in the form of a dot matrix where 10 and 8 dots are arranged vertically and horizontally (see exemplary character patterns of FIG. 2(*a*)–2(*d*) as will be described below). Consequently, the number of dots belonging to each horizontal line of the dot matrix of the character pattern of the character designated is sequentially scanned from the lowermost horizontal line before being stored. The reason for the scanning to be sequentially carried out from the lowermost horizontal line is that the lowermost horizontal line of a character to be printed on the recording paper 1 comes in first of the others in time series. Data strings are stored in each of the line buffers 8Y, 8R, 8B and their addresses are so arranged as to correspond to respective positions over the graduated width of the recording paper 1 (=the scale plate 7). As a binary code "1" or "0" indicating whether or not a dot is printed is stored at each address, the data string is used to indicate a temperature value at a certain point of time and one horizontal line of the character pattern. Therefore, one character pattern is completed by repeating a travel over the graduated width the same number of times as that of vertical dots of the character dot matrix, that is 10 times. The travel over the graduated width 10 times is hereinafter called "a one character travel". As will be described in detail later, seven colors in total are formed with each of the three colors, a mixture of two out of the three colors and all the three colors, whereby the code 1, is to be stored at the same address of the corresponding line buffer with respect to a single color and the plurality of line buffers in accordance with the kinds of the mixed colors.

Accordingly, an embodiment of the present invention involves moving an ink-jet recording head having a first nozzle in a traveling direction over a width of the recording paper a number of times corresponding to the number of vertical lines of a character dot matrix. This number of times the recording head moves also corresponds to the number of dots in one vertical line of the number of vertical lines of the character dot matrix. Also, to accommodate intermittently fed belt-like recording paper, an embodiment of the present invention prints a character from the last line to the first line of a character dot matrix.

The operating unit includes a pulse generator 22 for driving the feed motor 3, a pulse generator 23 for driving the traveling motor 6, the write and read units 10, 20 relating to the line buffers 8Y, 8R, 8B, and a timing control unit 21 for timing the operation of the pulse generators 22, 23. The pulse generator 22 for feeding purposes generates one pulse every 30 seconds to feed the recording paper 1 by 0.4 mm (equivalent to a recording paper feeding speed of 50 mm/h) via the motor 3. The pulse generator 23 for traveling purposes continuously generates a pulse train every 30 seconds, which causes the traveling stand 5 and the recording head 4 to travel via the motor 6 once over the whole recording width. The traveling is reciprocated alternately in the forward and backward directions every 30 seconds.

The entire operation of the recorder will subsequently be given in view of time series.

(1) At a certain point of time, the pulse generated by the pulse generator 22 every 30 seconds causes the recording paper 1 to be fed by 0.4 mm.

(2) The data retaining the measured temperature value stored in the data buffer 12 and the character buffer 14, and the data relating to one horizontal line of the pattern of the character designated are separately written by the write unit 10 into the line buffers 8Y, 8R, 8B in accordance with the respective printing colors. The writing time is regulated by the timing control unit 21.

(3) Upon the termination of writing, the pulse from the pulse generator 23 has the travel motor 6 started, thus making the traveling stand 5 and the recording head 4 travel once over the whole recording width. The traveling time is regulated by the timing control unit 21.

(4) The data stored in the line buffers 8Y, 8R, 8B are sequentially read by the read unit 20 through the pulse from the pulse generator 23 in synchronization with the traveling of the recording head 4 before being each sent to corresponding drive units 30Y, 30R, 30B.

(5) The drive signals (voltages) output from the drive units 30Y, 30R, 30B are each applied to corresponding piezoelectric elements 9Y, 9R, 9B, so that corresponding color ink is jetted when the traveling recording head 4 arrives at a position where printing is to be made. By this ink-jet dot printing, the temperature value at a certain point of time and one horizontal line of the dot matrix of the character are printed on the recording paper 1.

(6) When the recording paper 1 is again fed by 0.4 mm 30 seconds later, the temperature value at this point of time and another horizontal line immediately above the preceding one of the dot matrix of the character are printed. One character pattern is completed by repeating the traveling of the recording head 4 over the graduated width 10 times in total every 30 seconds; in other words, it is completed by one character travel. Consequently, the dot-to-dot character vertical interval is equivalent to 0.4 mm per feed of the recording paper 1.

FIGS. 2(*a*), 2(*b*), 2(*c*) and 2(*d*) are diagrams illustrating exemplary character patterns, where FIG. 2(*a*) represents numeric characters 0, 1, 2, 3, 4, 5; FIG. 2(*b*) alphabets T, U, V, W, X, Y; FIG. 2(*c*) katakana of "0", "Ka", "Ki", "Ku", "Ke", "Ko"; and FIG. 2(*d*) various symbols. Any one of the character patters is formed with a matrix having vertical 10 dots and horizontal 8 dots. With an arrangement of horizontal 8 dots by vertical 10 dots, one-byte processing is made possible; that is, the processing can be not only simplified from the standpoint of software but also expedited. Moreover, the character becomes easier to look at than characters having horizontal 5 dots and vertical 7 dots conventionally.

Figure 3:
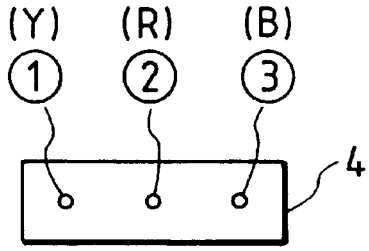
FIG. 3 is a top view of a recording head having nozzles for three colors.
Figure 4A:
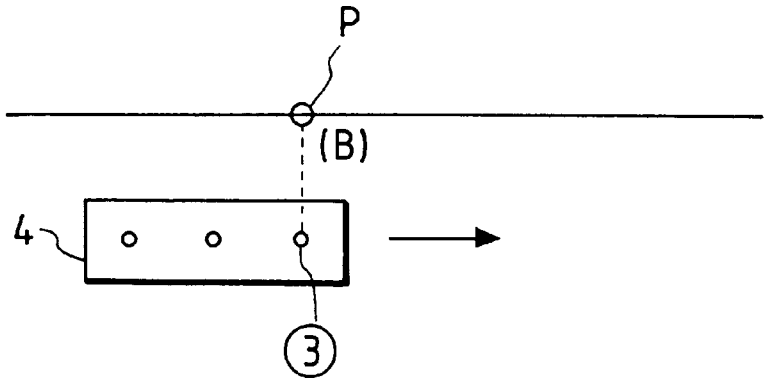
FIGS. 4(*a*), 4(*b*) and 4(*c*) show respective process steps of mixed color printing operations performed by the recording head.
Figure 4B:
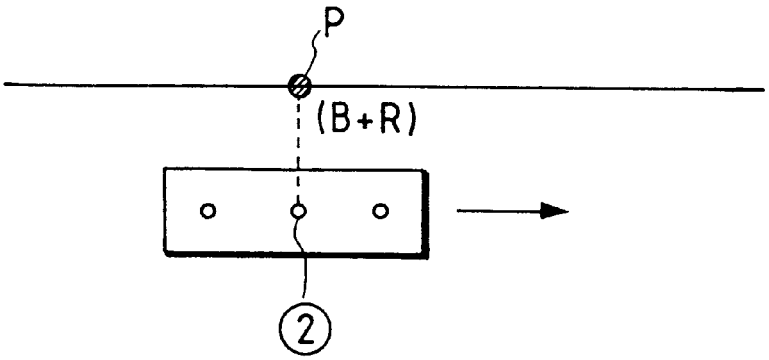
Figure 4C:
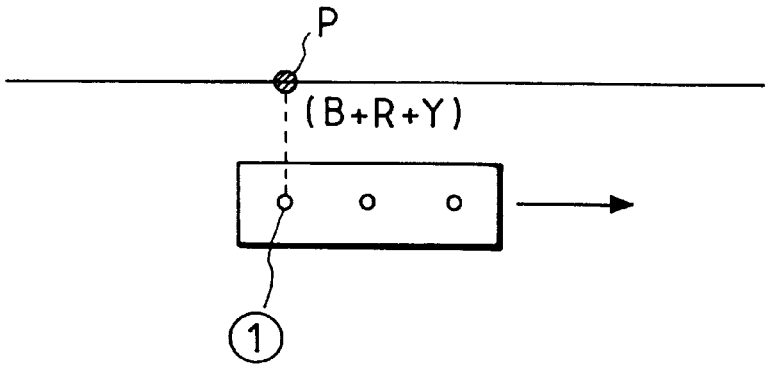
Figures 5, 6:
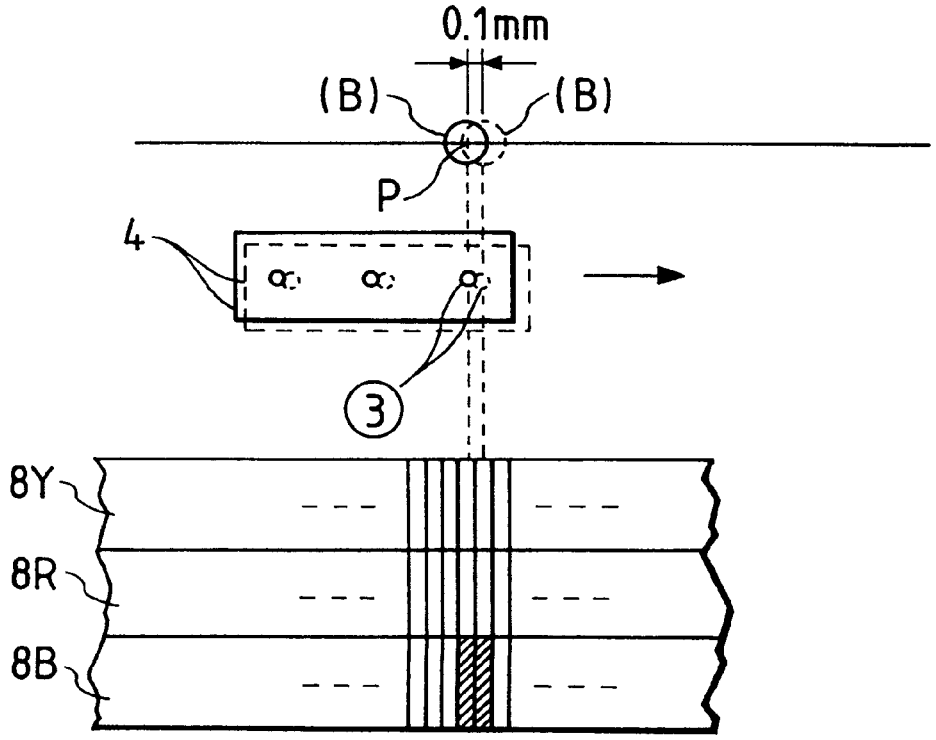
FIG. 5 is a table of seven kinds of printing colors corresponding to three colors in combination.
FIG. 6 is an exemplary diagram illustrating the monochromatic superimposing printing operation.

Referring to FIGS. 3, 4(*a*)–4(*c*) and 5, mixed color printing will be described. FIG. 3 is a top view of a recording head having nozzles for three colors. FIGS. 4(*a*) to 4(*c*) depict mixed color printing operations performed by the recording head: FIGS. 4(*a*), 4(*b*) and 4(*c*) are diagrams exemplarily illustrating respective process steps. FIG. 5 is a table of seven kinds of printing colors corresponding to three colors in combination. In FIG. 3, the recording head 4 is equipped with three nozzles (1), (2), (3) arranged in parallel at intervals of 0.5 mm in a travelling direction (the horizontal direction). These nozzles (1), (2), (3) are each used to jet ink of yellow (Y), red (R) and blue (B). As will be described in detail below, there is employed a printing method using (1) each of the colors pertaining to the nozzles (1), (2), (3) independently, and (2) two or three colors for overstriking and so forth.

Now assuming that P represents a printing point and that printing is carried out while the recording head 4 is traveling to the right in FIGS. 4(*a*)–4(*c*), blue (B) color is printed at the point P while the nozzle (3) is passing the point P because the nozzle (3) is the first one (see FIG. 4(*a*)). When purple color is printed at the point P, red (R) color is superimposed thereon while the second nozzle (3) is passing the point P (see FIG. 4(*b*)). When black color is printed at the point P, yellow (Y) is further superimposed thereon when the nozzle (1) is passing the point P (see FIG. 4(*c*)). The point P printed in black is thus obtained.

In FIG. 5, there are shown Nos. 1, 2, 3, . . . , 7 relevant to colors in the leftmost column; printing colors, yellow, red, blue, bitter orange, purple, green and black, in the next column on the right-hand side; and a mark o indicating which one of the colors, yellow, red and blue, is to be combined therewith as corresponding superimposing colors in the rightmost column. In the case of No. 5, for example, it means that the recording color is purple simultaneously with the combination of red and blue to be superimposed. In a case where the required kinds of colors are actually less than seven, however, selections are properly made from among the seven kinds of colors.

Although printing of four colors, bitter orange, green, purple and black, is made available by mixing two out of three colors, yellow, red and blue, or all the three colors, the mixed color printing requires a total amount of ink for each printing dot twice as large as monochromatic printing when two colors are used and three times when three colors are used. Consequently, a recording line and a character that have been printed become slightly thicker than those in the case of monochromatic printing of one printing dot. In order to obviate the shortcoming, there is employed a technique of doubling monochromatic printing at one printing dot. When three-color mixed printing is carried out to implement black color printing, the amount of ink becomes three times as great as what is required for monochromatic printing, which makes the printing line thicker than that in the case of two-color mixed printing, though this is an exception.

Referring to FIG. 6, a description will be given of a monochromatic superimposing printing technique applicable to blue (B) color printing by way of example. FIG. 6 is an exemplary diagram illustrating the monochromatic superimposing printing operation. In FIG. 6, blue (B) color is printed at the normal position P while the recording head 4 is traveling in the direction of an arrow. The position of the recording head 4 then is indicated with a continuous line and the nozzle (3) corresponding to blue color accords with the position P. Blue ink is jetted according to the code "1" set at the corresponding address (on the left-hand side of an area with tilted hatching) of the line buffer 8B and a blue (B) color dot indicated at the position P encircled with a continuous line is printed first time. In this case, a code "0" is to be prestored at a blank address and, within the range of illustration therein, all addresses in the other line buffers 8Y and 8R also remain blank. When the recording head 4 proceeds by 0.1 mm from the position P in the direction of the arrow as shown by a broken line, a blue (B) color dot is printed second time as blue ink is jetted from the nozzle (3). The second-time ink jet is based on the code "1" set at an address on the right-hand side of the area with tilted hatching of the line buffer 8B. In this case, the travel distance between the adjoining addresses of the line buffer is 0.1 mm. Further, the diameter of one printing dot is approximately 0.3 mm. Properly speaking, the first and second blue (B) color dots should completely be superimposed at the normal position P when they are printed; however, that deviation has been regarded as what practically poses no problem because the superimposing operation is technically very difficult.

Figure 7:
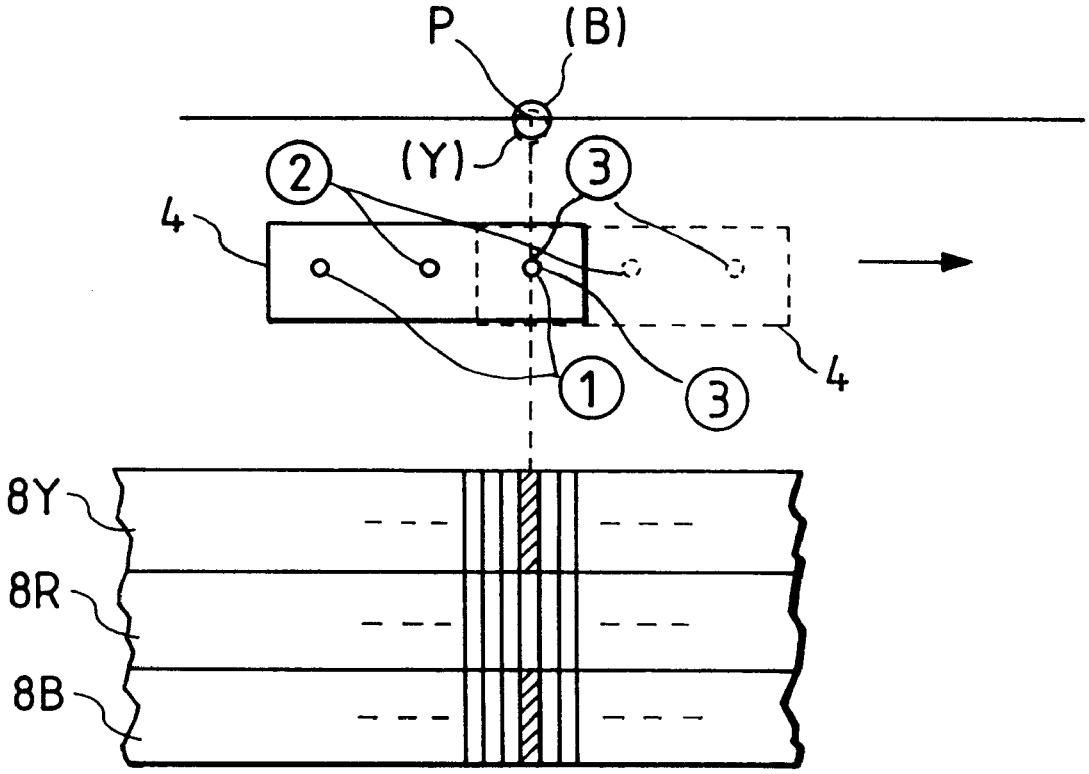
FIG. 7 is an exemplary diagram illustrating the mixed color superimposing printing operation.

Subsequently, a description will be given of mixed color printing of two colors, blue and yellow, by reference to an exemplary diagram illustrating the mixed color superimposing printing operation of FIG. 7 in comparison with the monochromatic printing. In FIG. 7, blue (B) color is to be printed at the position P while the recording head 4 is traveling in the direction of an arrow. The position of the recording head 4 then is indicated with a continuous line and the nozzle (3) corresponding to blue color accords with the position P. Blue ink is jetted according to the code "1" set at the corresponding address with tilted hatching of the line buffer 8B and a blue (B) color dot indicated at the position P encircled with a continuous line is printed. When the recording head 4 proceeds to the position indicated with a broken line, the nozzle (1) corresponding to yellow color accords with the position P and yellow ink is jetted according to the code "1" set at the corresponding address with tilted hatching of the line buffer 8Y, so that a yellow (Y) color dot encircled with a broken line is printed. Although the blue and yellow color dots are seen to have slightly shifted from each other in the vertical direction in this case, this is only for convenience of illustration and actually they have completely been combined together.

Since the ink-jet recording head of the recorder is used according to the present invention to print measuring point numbers along the recording line of recording paper simultaneously with memos, messages and the like for giving opinions or sending requests in the form of characters, the contents that have heretofore been written manually by the operator can be recorded appealingly and neatly without mistakes with the sense of operating a printer. Moreover, such recording is achievable only by implementing additional software, whereby an increase in cost can be restrained. It is also possible to carry out not solely single black color printing but also seven kinds of multicolor printing which employs bitter orange, green, purple and black in addition to yellow, red and blue by mixing two or three kinds of colors together. Therefore, the character looks attractive with important matter emphasized and is set freer from misperception. Although it is disadvantageous that the two-color mixed character looks slightly thicker than the single-color one due to the fact that the total amount of adhering ink is doubled when a mixture of single-color and two-color characters exists, such disadvantage can simply be obviated by deviating only the single-color character by a quantity corresponding to adjoining one address on the line buffer from its central position by means of software so as to carry out superimposing printing. With the arrangement of horizontal 8 dots by vertical 10 dots, one-byte processing is made possible; that is, the processing can be not only simplified from the standpoint of software but also expedited. Moreover, the character becomes easier to look at than what has horizontal 5 dots and vertical 7 dots conventionally.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of printing a character for an ink-jet recorder, comprising the steps of:

intermittently feeding a belt-like recording paper a predetermined amount during a predetermined period;

defining a character dot matrix having a number of horizontal lines, including an uppermost horizontal line and a lowermost horizontal line, and a number of vertical lines, said character dot matrix forming a character pattern having a top and a bottom, said lowermost horizontal line corresponding to said character pattern bottom and said uppermost horizontal line corresponding to said character pattern top;

moving an ink-jet recording head having a first nozzle in a traveling direction over a width of the recording paper a number of times corresponding to a number of dots in one vertical line of said number of vertical lines of said character dot matrix;

causing ink to be jetted from said first nozzle of said recording head when said first nozzle passes a position corresponding to a dot in one of said number of horizontal lines; and printing dots from said lowermost horizontal line first and dots from said uppermost horizontal line last.

2. A method of printing a character as claimed in claim 1, wherein said recording head has a plurality of nozzles arranged in parallel to said traveling direction of said recording head for jetting ink of plural colors; and wherein the method further comprising the step of selecting said first nozzle from said plurality of nozzles from which ink is jetted for color printing.

3. A character printing method as claimed in claim 2, wherein the mixed color printing is performed by superimposing color of at least two colors.

4. A character printing method as claimed in claim 2, wherein said selecting step includes the substeps of:

jetting a first dot from said first nozzle;

moving said recording head to a position defined by a value stored in a line buffer;

jetting a second dot from one of said plurality of nozzles superimposed over said first dot.

5. A method of printing a character as claimed in claim 2, wherein said selecting step includes the substep of printing a single color.

6. A method of printing a character as claimed in claim 2, wherein said selecting step includes the substep of printing mixed colors.

7. A character printing method as claimed in claim 1, wherein said recording head has three nozzles, and wherein the method further comprises the step of selecting said first nozzle from said plurality of nozzles from which ink is jetted in colors of yellow, red and blue.

8. A character printing method as claimed in claim 1, wherein the dot matrix is formed with strings of 8 horizontal dots by 10 vertical dots.

* * * * *